US008682499B2

(12) United States Patent
Pachner et al.

(10) Patent No.: US 8,682,499 B2
(45) Date of Patent: Mar. 25, 2014

(54) COMBUSTION AIR CONTROL

(75) Inventors: Daniel Pachner, Praha (CZ); Ondrej Basus, Prague (CZ)

(73) Assignee: Honeywell International Inc., Morristown, NJ (US)

( * ) Notice: Subject to any disclaimer, the term of this patent is extended or adjusted under 35 U.S.C. 154(b) by 635 days.

(21) Appl. No.: 12/852,450

(22) Filed: Aug. 6, 2010

(65) Prior Publication Data

US 2012/0034568 A1 Feb. 9, 2012

(51) Int. Cl.
*G05D 23/00* (2006.01)

(52) U.S. Cl.
USPC ..... 700/299; 422/172; 110/261

(58) Field of Classification Search
USPC ..... 700/299; 422/172; 110/261
See application file for complete search history.

(56) References Cited

U.S. PATENT DOCUMENTS

| | | | | |
|---|---|---|---|---|
| 4,133,373 | A * | 1/1979 | Slagley et al. | 165/11.1 |
| 2004/0033184 | A1* | 2/2004 | Greer | 423/215.5 |
| 2006/0008393 | A1* | 1/2006 | Schindler | 422/172 |
| 2008/0264310 | A1* | 10/2008 | Jia et al. | 110/186 |
| 2010/0108567 | A1* | 5/2010 | Medoff | 208/49 |
| 2011/0048293 | A1* | 3/2011 | Grusha | 110/261 |

* cited by examiner

*Primary Examiner* — Mohammad Ali
*Assistant Examiner* — Anthony Whittington
(74) *Attorney, Agent, or Firm* — Brooks, Cameron & Huebsch, PLLC

(57) ABSTRACT

Embodiments of the present disclosure include devices and methods for controlling combustion air. For example, in one embodiment, a method for controlling combustion air includes determining an amount of leaking air in a boiler, determining a constant that depends on a heating value of a fuel in the boiler, and adjusting an amount of controlled air supplied to the boiler.

16 Claims, 2 Drawing Sheets

COMBUSTION AIR CONTROL

BACKGROUND

The present disclosure is related generally to the field of combustion. More particularly, the present disclosure is related to combustion air control.

Boilers can be equipped with air control systems. The amount of air supplied to a combustion chamber can determine the amount of pollutants, such as carbon monoxide (CO) and nitrous oxide ($NO_x$), among other pollutants, formed during combustion of fuel in the boiler and also the efficiency of the boiler.

In boilers, a minimum amount of air is necessary to completely burn a fossil fuel. The stoichiometric amount of air to completely burn a fossil fuel is the amount of air that contains exactly the number of oxygen molecules necessary to oxidize the fossil fuel completely.

A boiler with less than the stoichiometric amount of air can result in incomplete combustion of the fossil fuel, which leads to inefficient boiler operation. A boiler with more than the stoichiometric amount of air can avoid incomplete combustion of the fossil fuel, but may cause more energy to be lost in the stack of the boiler.

The energy lost due to excess air in the boiler can be called stack and/or sensible heat loss and is caused by using energy to heat the extra air during combustion which therefore is not used to create steam during the combustion process. Accordingly, stack heat loss also causes inefficient boiler operation.

The amount of air above stoichiometric air that provides an acceptable balance of the losses associated with unburned fossil fuel and stack heat loss can be called the excess air fraction. The excess air fraction can be dependent on many factors, such as boiler construction, air-fuel mixture homogeneity, fuel type, and boiler size, among other factors.

The excess air fraction can be related to the oxygen concentration in the flue gas of a boiler. An oxygen concentration of approximately 2% in the flue gas of a boiler can indicate approximately 10% of excess air. In some boilers, 10% of excess air may be utilized to minimize the total losses associated with unburned fossil fuel and stack heat loss.

Some boilers can include an air feedback control system to adjust the amount of air added to the combustion chamber of the boiler, so the suitable amount of excess air in the boiler can be maintained. For example, if less oxygen is sensed in the flue gas, the air to fuel ratio can be increased until the suitable amount of oxygen (e.g., 2%) is sensed in the flue gas.

However, controlling the exact amount of air in the combustion chamber may not be easily accomplished. Some boilers are operated at low pressure to prevent poisonous gases from escaping during the combustion process.

This lower pressure allows air to enter the boiler through gaps in and/or between various components of the boiler. The amount of air that enters the boiler uncontrolled may be referred to as leaking air. Some air feedback control systems lack the ability to compensate for leaking air during transients, e.g., when changing the power level of the boiler. when adjusting the air to fuel ratio to provide the suitable amount of excess air for the boiler and, therefore, may result in a loss of efficiency.

DETAILED DESCRIPTION

Embodiments of the present disclosure include devices and methods for controlling combustion air. For example, in one embodiment, a method for controlling combustion air includes determining an amount of leaking air in a boiler, determining a constant that depends on a heating value of a fuel in the boiler, and adjusting an amount of controlled air supplied to the boiler.

In some embodiments, measuring the boiler's flue gas oxygen concentration can be used to determine the amount of leaking air in the boiler. The amount of leaking air in the boiler can be calculated based on the flue gas oxygen concentration of the boiler, the boiler power output, the amount of controlled air in the boiler, and the air/energy constant for the fuel used in the boiler.

In some embodiments, the constant that depends on the heating value of the fuel in the boiler can be calculated based on the fuel flow rate to the boiler, the amount of controlled air supplied to the boiler, the amount of leaking air in the boiler, and the flue gas oxygen concentration of the boiler.

The amount of controlled air supplied to the boiler can be based on the determined amount of leaking air in the boiler, the determined constant that depends on the heating value of the fuel in the boiler, and a desired amount of excess air for the boiler. For example, the amount of controlled air supplied to the boiler can be adjusted based on the determined amount of leaking air in the boiler and the determined air to fuel mass ratio for the boiler each time a fuel supply rate for the boiler is changed, at periodic intervals, and/or during a load change for the boiler.

In the following detailed description of the present disclosure, reference is made to the accompanying drawings that form a part hereof, and in which is shown by way of illustration how one or more embodiments of the disclosure may be practiced. These embodiments are described in sufficient detail to enable those of ordinary skill in the art to practice the embodiments of this disclosure, and it is to be understood that other embodiments may be utilized and that process, electrical, and/or structural changes may be made without departing from the scope of the present disclosure.

Figure 1:
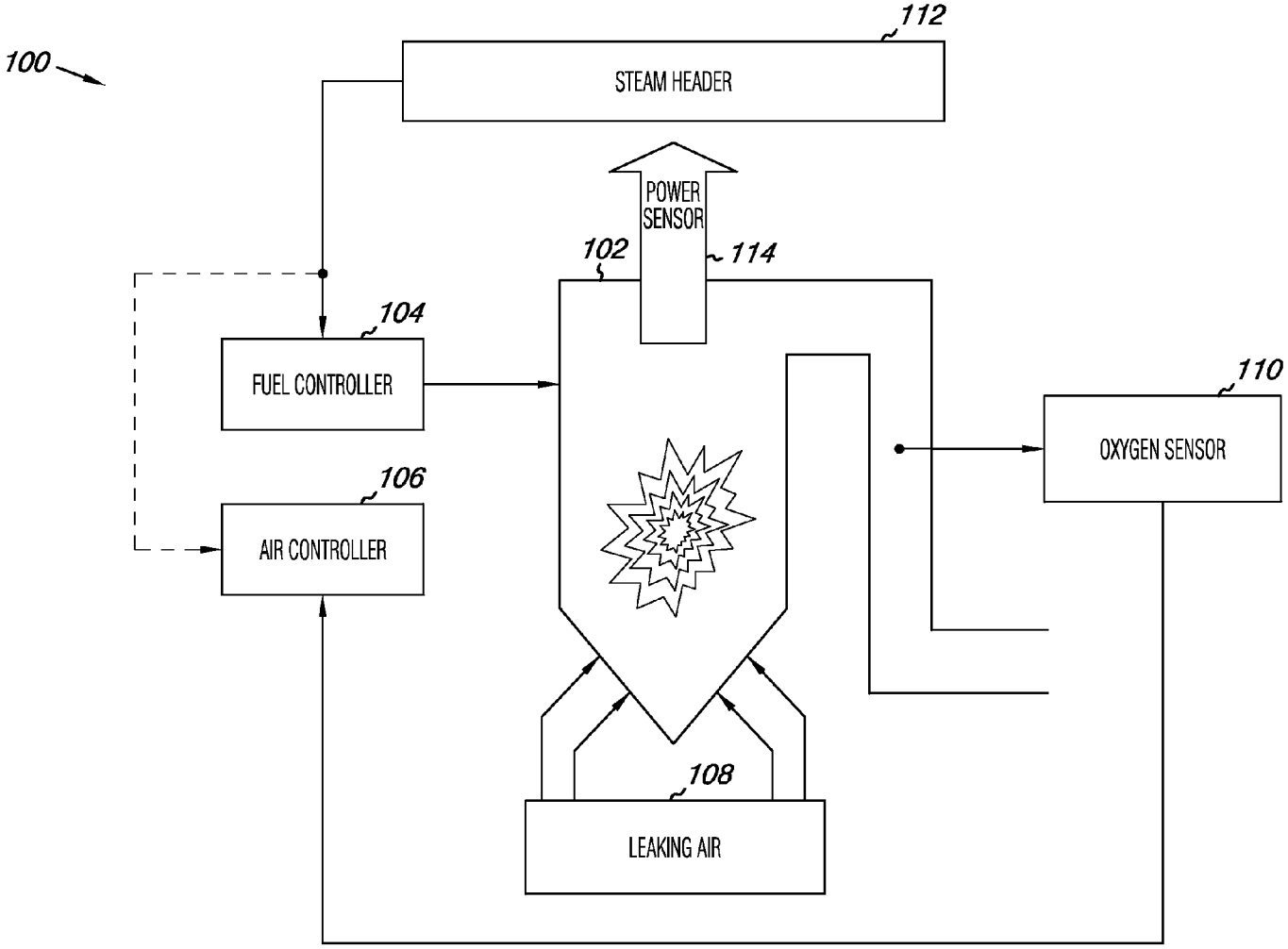
FIG. 1 illustrates an embodiment of a combustion air control system.

FIG. 1 illustrates an embodiment of a combustion air control system. In FIG. 1, the combustion air control system 100 includes a boiler 102 for combustion of fossil fuels.

The combustion of fossil fuels in the boiler 102 can, for example, create heat that is used to generate electricity via a steam generator. The heat created by combustion of fossil fuels in the boiler 102 can be used for any energy generation techniques that use heat.

In FIG. 1, fuels, e.g., fossil fuels, such as coal, among others, are supplied to the boiler 102 via fuel controller 104. The fuel supply rate for the boiler 102 can be dependent on a desired power output and/or load for the boiler 102.

The air for combustion of the fuel in the boiler is supplied to boiler 102 via the air controller 106. The amount of air supplied to the boiler for combustion of the fuel can determine the composition of the emissions associated with combustion in the boiler.

The emissions associated with combustion in the boiler can have undesirable pollutants such as carbon monoxide (CO), nitrous oxide ($NO_x$), and/or other pollutants. The amount of pollutants in the emissions associated with combustion in the boiler can vary with the amount of air in the boiler when the fuel combusts.

The amount of air in the boiler when the fuel combusts can include controlled air, which is supplied to the boiler via the air controller 106, and leaking air 108, which enters the boiler through gaps in and/or between the components, such door seams for example, of the boiler. The leaking air can, for example, enter through gaps in the components of the boiler because the combustion chamber of the boiler is kept at a pressure that is less than atmospheric pressure so poisonous gases produced during combustion don't escape through gap in the components of the boiler. The amount of leaking air cannot be controlled by the air control system and varies based on the construction of the boiler and/or pressure at which the boiler operates, among other factors.

The heat generated through the combustion of fuel in the boiler 102 creates energy that is used to create steam in header 112 by heating feed water. The steam in header 112 can be used to power a steam turbine generator that can generate electricity, for example. The power generated through the combustion of fuel in the boiler can be calculated by a power sensor 114 and can be a function of, for example, the steam flow, steam pressure, steam temperature, feed water flow, feed water temperature, flue gas flow, and/or flue gas temperature for the boiler.

The boiler's flue gas oxygen concentration can be measured by an oxygen sensor 110. The boiler's flue gas oxygen concentration can indicate the amount of excess air that is present during combustion of the fuel in the boiler. For example, a flue gas oxygen concentration of approximately 2% can correspond to 10% excess air in the boiler during combustion. In some boilers, 10% excess air can be desirable as it provides sufficient balance between the losses associated with unburned fossil fuel and stack heat loss.

The combustion air control system 100 can use the measurements from the oxygen sensor 110, the power sensor 114, the air controller 106, and fuel controller 104 to determine the amount of controlled air to supply to the boiler. The amount of controlled air supplied to the boiler is controlled so the boiler operates at a desired oxygen set point.

Figure 2:
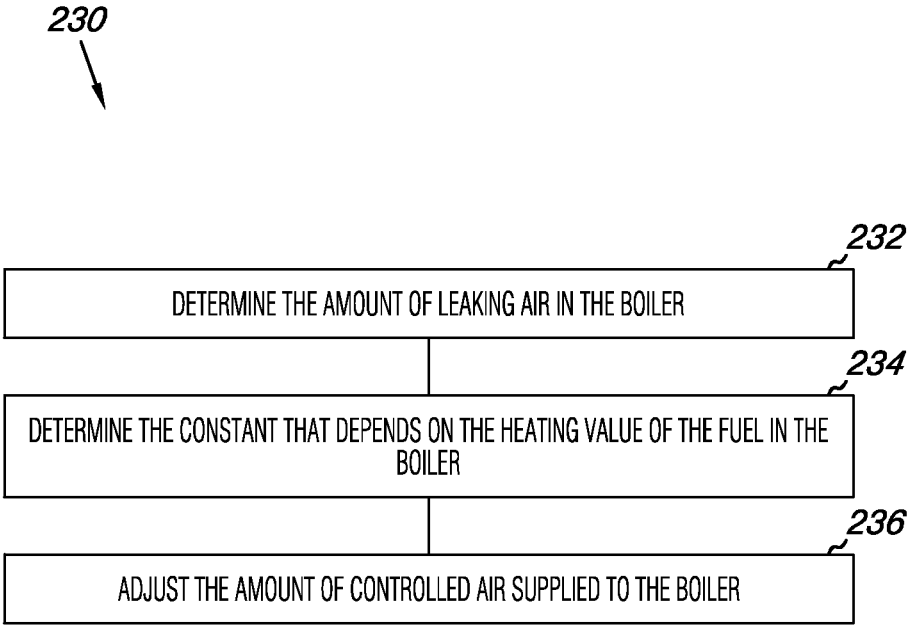
FIG. 2 illustrates an embodiment of a method flow for controlling combustion air in a boiler.

FIG. 2 illustrates an embodiment of a method flow for controlling combustion air in a boiler. The method of controlling combustion air in a boiler 230 of FIG. 2 includes determining the amount of leaking air in the boiler 232.

The amount of leaking air the boiler cannot be measured directly, but can, for example, be calculated by measuring the power output of the boiler and the flue gas oxygen concentration. The amount of leaking air can be calculated by solving the following equation for the amount of leaking air ($A_L$):

$$O_2 = 21 \cdot \left\{1 - a\frac{P}{A_c + A_L}\right\}$$

where $O_2$ is the oxygen concentration in the flue gas, a is the air/energy constant for the fuel, P is the power output of the boiler, $A_c$ is the amount of controlled air supplied to the boiler, and $A_L$ is the amount of leaking air entering the boiler.

The power output of the boiler (P) can be determined by measuring various factors such as the steam flow, steam pressure, steam temperature, feed water flow, feed water temperature, flue gas flow, and/or flue gas temperature of the boiler. The flue gas oxygen concentration can be measured by an oxygen sensor in the stack of the boiler and the amount of controlled air supplied to the boiler can be measured by the air controller. The air/energy constant for the fuel (a) is known for a fuel type and does not vary based upon the fuel composition, which makes the equation above independent of the fuel composition. Therefore the air/energy constant (a) for the fuel is known and can be used to solve for variables in the above equation. Also, the air/energy constant (a) does not significantly vary among different fuel types. In some embodiments a value, such as of 0.316, for example, can be used for the air/energy constant (a) in the above equation for any type of fossil fuel that is being used in the boiler, which makes the above equation independent of the fuel type and fuel composition. Once these values are measured and inserted into the above equation, the amount leaking air entering the boiler can be determined by solving the above equation for $A_L$.

In some embodiments, controlling combustion air in a boiler 230 can include determining the heating value of the fuel in the boiler 234. Determining the heating value of the fuel in the boiler 234 can include using the calculated amount of leaking air along with the flue gas oxygen concentration, the fuel flow rate, and/or the amount of controlled air supplied to the boiler. The constant k, which depends on the heating value of the fuel in the boiler, can be calculated by solving the following equation for the constant k:

$$O_2 = 21 - k\frac{F}{A_C + A_L}$$

where $O_2$ is the oxygen concentration in the flue gas, k is a constant which depends on the heating value of the fuel, F is the fuel flow rate to the boiler, $A_c$ is the amount of controlled air supplied to the boiler, and $A_L$ is the amount of leaking air entering the boiler.

During operation of the boiler, the constant k, which depends on the heating value of the fuel, varies with the type and quality of fuel and is typically not a readily measurable value. Also, the amount of leaking air entering the boiler is typically not measurable. Therefore the following equation, $$O_2 = 21 - k\frac{F}{A_C + A_L},$$

includes two typically immeasurable values, k and $A_L$.

The following equation, $$O_2 = 21 \cdot \left\{1 - a\frac{P}{A_c + A_L}\right\},$$

as discussed above can be used to solve for the amount of leaking air entering the boiler ($A_L$). The fuel flow rate to the boiler (F), the amount of controlled air supplied to the boiler ($A_c$), and the flue gas oxygen concentration ($O_2$) can be measured and along with the calculated amount of leaking air entering the boiler ($A_L$) can be inserted into the following equation, $$O_2 = 21 - k\frac{F}{A_C + A_L},$$

to calculate the constant k, which depends on the heating value of the fuel in the boiler.

Once the constant k and the amount of leaking air entering the boiler ($A_L$) are determined, the following equation, $$O_2 = 21 - k\frac{F}{A_C + A_L},$$

can be used to calculate the amount of controlled air to supply to the boiler for the boiler to operate at a desired flue gas oxygen concentration set point. For a desired flue gas oxygen concentration set point, the following equation, $$O_2 = 21 - k\frac{F}{A_C + A_L},$$

can be solved for the amount of controlled air ($A_c$) needed to be supplied to the boiler by inserting the measured fuel flow rate to the boiler (F) and the calculated, as discussed above, constant k and the amount of leaking air entering the boiler ($A_L$).

Once the amount of controlled air supplied to the boiler ($A_c$) needed to operate the boiler at a desired flue gas oxygen set point for a boiler operating is determined using the determined amount of leaking air entering the boiler ($A_L$) and the determined constant k, the combustion air in the boiler can be controlled, for example, by adjusting the amount of controlled air supplied to the boiler 236 with an air controller.

In some embodiments, controlling combustion air in the boiler 230 can be useful, for example, when the load is changing in the boiler. When the load is changing the in boiler, the fuel supply rate (F) is changing over time and it can be difficult to maintain a desired excess air and $O_2$ level by only adjusting the controlled air supplied to the boiler based on the flue gas oxygen concentration. For example, adjusting the controlled air supplied to the boiler just based on flue gas oxygen concentration measurements while the load on the boiler is changing can cause an undesired balance in the combustion process resulting in excessive pollutants in the flue gas and/or losses associated with unburned fossil fuel and stack heat loss.

In some embodiments, adjusting the amount of controlled air supplied to the boiler 236 based on the determined amount of leaking air entering the boiler and the determined constant k, which depends on the heating value of the fuel in the boiler, can allow for a desired amount of excess air in the combustion process even when the load is changing in the boiler.

In some embodiments, the amount of controlled air supplied to the boiler 236 based on the determined amount of leaking air entering the boiler and the determined constant k can be done at periodic intervals, during a load change for the boiler, and/or during a fuel change for the boiler, among other periods.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

As used herein, the term "and/or" includes any and all combinations of one or more of the associated listed items. It will be understood that, although the terms first, second, etc. may be used herein to describe various elements and that these elements should not be limited by these terms. These terms are only used to distinguish one element from another element. Thus, a first element could be termed a second element without departing from the teachings of the present disclosure.

It is to be understood that the use of the terms "a", "an", "one or more", "a number of", or "at least one" are all to be interpreted as meaning one or more of an item is present. Additionally, it is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for controlling combustion air, comprising:

determining an amount of leaking air in a boiler ($A_L$) by measuring an oxygen flue gas concentration ($O_2$) of the boiler, a boiler power output (P), and an amount of controlled air in the boiler ($A_C$) and solving equation $O_2=21\cdot\{1-a\cdot(P)/(A_C+A_L)\}$ for the amount of leaking air in a boiler ($A_L$) using the measured flue gas oxygen concentration of the boiler ($O_2$), the measured boiler power output (P), the measured amount of controlled air in the boiler ($A_C$), and an air/energy constant (a) for the fuel used in the boiler;

determining a constant (k), wherein the constant depends on a heating value of a fuel in the boiler; and adjusting an amount of controlled air supplied to the boiler based on the determined amount of leaking air in the boiler and the determined constant.

2. The method of claim 1, wherein adjusting the amount of controlled air supplied to the boiler provides approximately 10% excess air for a combustion process of the boiler.

3. The method device of claim 1, wherein determining the constant that depends on the heating value of the fuel in the boiler includes calculating the constant that depends on the heating value of the fuel in the boiler based on a fuel flow rate to the boiler, an amount of controlled air supplied to the boiler, the amount of leaking air in the boiler, and a flue gas oxygen concentration of the boiler.

4. The method of claim 1, wherein adjusting the amount of controlled air supplied to the boiler is based on the determined amount of leaking air in the boiler, the determined constant that depends on the heating value of the fuel in the boiler, and a desired amount of excess air for the boiler.

5. The method of claim 1, wherein the method includes adjusting the amount of controlled air supplied to the boiler based on the determined amount of leaking air in the boiler and the determined constant each time a fuel supply rate for the boiler is changed.

6. The method of claim 1, wherein the method includes adjusting the amount of controlled air supplied to the boiler based on the determined amount of leaking air in the boiler and the determined constant at periodic intervals.

7. The method of claim 1, wherein the method includes adjusting the amount of controlled air supplied to the boiler based on the determined amount of leaking air in the boiler and the determined constant during a load change for the boiler.

8. A combustion air control device, comprising:

a power sensor, wherein the power sensor measures a power output of a boiler;

an oxygen sensor, wherein the oxygen sensor measures a boiler's flue gas oxygen concentration;

an air controller, wherein the air controller controls an amount of air supplied to the boiler based on an amount of leaking air in a boiler ($A_L$) that is calculated using the power output of the boiler, the boiler's flue gas oxygen concentration, and a constant (k) that depends on a heating value of a fuel in the boiler, so that the boiler's flue gas oxygen concentration is at an oxygen concentration set point; and a fuel controller, wherein the fuel controller controls an amount of fuel supplied to the boiler based on a desired boiler load.

9. The device of claim 8, wherein the power sensor measures the power output of the boiler based on at least one of steam flow, steam pressure, steam temperature, feed water flow, feed water temperature, flue gas flow, and flue gas temperature for the boiler.

10. The device of claim 8, wherein the oxygen concentration set point is approximately 2%.

11. The device of claim 8, wherein the air controller controls the amount of air supplied to the boiler based on the amount of leaking air in a boiler ($A_L$) and the constant (k) that depends on a heating value of a fuel in the boiler during a load change for the boiler.

12. A combustion air control system, comprising:

a boiler; wherein the boiler includes a combustion chamber;

an air controller, wherein the air controller controls the amount of air supplied to the boiler for boiler operation at a desired oxygen concentration set point based on an amount of leaking air in a boiler ($A_L$) that is calculated by solving equation $O_2=21\cdot\{1-a\cdot(P)/(A_C+A_L)\}$ for the amount of leaking air in a boiler ($A_L$) using a measured flue gas oxygen concentration of the boiler ($O_2$), a measured boiler power output (P), a measured amount of controlled air in the boiler ($A_C$), and an air/energy constant (a) for the fuel used in the boiler and a constant (k) that depends on a heating value of a fuel in the boiler during a transition period where a load of the boiler is changing; and a fuel controller, wherein the fuel controller controls an amount of fuel supplied to the boiler.

13. The system of claim 12, wherein the amount of air supplied for boiler operation at the desired oxygen concentration set point based on the constant that depends on the heating value of the fuel in the boiler is determined by calculating the constant that depends on the heating value of the fuel in the boiler using an amount of fuel supplied to the boiler, an amount of air being supplied to the boiler, and the amount of leaking air in the boiler.

14. The system of claim 13, wherein the amount of leaking air entering the boiler is calculated by measuring the boiler's flue gas oxygen concentration, the power output of the boiler, and an amount of oxygen supplied to the boiler.

15. The system of claim 13, wherein the constant that depends on the heating value of the fuel in the boiler is calculated by measuring an amount of oxygen supplied to the boiler and the fuel flow to the boiler and the calculated amount of leaking air entering the boiler.

16. The system of claim 13, wherein system includes a power sensor that measures the power output of the boiler based on at least one of steam flow, steam pressure, steam temperature, feed water flow, feed water temperature, flue gas flow, and flue gas temperature for the boiler.

* * * * *